United States Patent [19]

Colle, Jr. et al.

[11] Patent Number: 4,702,168

[45] Date of Patent: Oct. 27, 1987

[54] SIDEWALL CORE GUN

[75] Inventors: Edward A. Colle, Jr., Houston; Donald N. Yates, Jr., Katy, both of Tex.; Emmet F. Brieger, Nogal, N. Mex.

[73] Assignee: Halliburton Company, Duncan, Okla.

[21] Appl. No.: 824,982

[22] Filed: Jan. 29, 1986

Related U.S. Application Data

[62] Division of Ser. No. 556,881, Dec. 1, 1983, Pat. No. 4,609,056.

[51] Int. Cl.[4] ..... F42D 3/00

[52] U.S. Cl. ..... 102/313; 102/312; 102/318; 102/321; 102/331; 102/275.4; 299/13

[58] Field of Search ..... 102/275.2, 275.3, 275.4, 102/275.8, 312, 313, 318; 299/13

[56] References Cited

U.S. PATENT DOCUMENTS

| | | | |
|---|---|---|---|
| 2,055,506 | 9/1936 | Schlumberger | 175/4 |
| 2,336,819 | 12/1943 | Turechek | 175/4.58 |
| 2,707,438 | 5/1955 | Mann et al. | 102/275.3 |
| 3,002,559 | 10/1961 | Hanes | 166/63 |
| 3,075,462 | 1/1963 | Adamson, Jr. | 175/4.58 |
| 3,227,228 | 1/1966 | Bannister | 175/4 |
| 3,672,301 | 6/1972 | Abbott | 102/530 |
| 3,893,395 | 7/1975 | Kilmer | 102/275.4 |
| 3,945,322 | 3/1976 | Carlson et al. | 102/275.4 |
| 4,313,380 | 2/1982 | Martner et al. | 102/320 X |
| 4,335,652 | 6/1982 | Bryan | 102/275.3 X |
| 4,339,947 | 7/1982 | Wiley | 175/4 |
| 4,481,884 | 11/1984 | Yunan | 102/275.4 X |
| 4,609,056 | 9/1986 | Colle, Jr. et al. | 102/531 X |
| 4,614,156 | 9/1986 | Colle, Jr. et al. | 102/275.3 X |
| 4,616,566 | 10/1986 | Yates, Jr. | 102/275.4 X |

FOREIGN PATENT DOCUMENTS

| | | | |
|---|---|---|---|
| 268170 | 5/1969 | Austria | 175/4 |

*Primary Examiner*—Peter A. Nelson

*Attorney, Agent, or Firm*—James R. Duzan

[57] ABSTRACT

Disclosed herein is a sidewall core gun attached to the lower end of a drill string, enabling the taking of core samples from within a deviated borehole. The gun also includes an improved charge assembly, including a detonatable core and one or more deflagratable cartridge assemblies for propelling a coring bullet from the gun to the sidewall of the borehole. Coring bullets imbedded in the sidewall remain connected to the gun via steel cables, whereby the bullets may be retrieved by raising the drill string.

2 Claims, 8 Drawing Figures

SIDEWALL CORE GUN

This application is a division of application Ser. No. 556,881, filed 12/1/83, and now U.S. Pat. No. 4,609,056.

BACKGROUND OF THE INVENTION

The present invention relates to the art of taking core samples from within a well bore and, more particularly, to apparatus for taking a plurality of core samples from the sidewall of a borehole. Still more particularly, the present invention relates to core sampling apparatus capable of taking samples from within a deviated borehole.

The use of a sidewall core gun to take a formation sample from the sidewall of a borehole is well known. U.S. Pat. Nos. 2,928,658; 2,937,005; 2,976,940; 3,003,569; 3,043,379; 3,080,005; and 4,280,568 disclose various types and aspects of sidewall core guns. Typically, a sidewall core gun comprises a cylindrical gun housing suspended on a wireline at a predetermined depth within the borehole. Included within the housing oriented radially outwardly is a plurality of means for taking core samples. In U.S. Pats. Nos. 2,937,005; 3,003,569; and 4,280,568, the sampling means comprises a hollow coring bullet which, when launched into the sidewall, will cut away a sample of the sidewall and retain that sample within the hollow center of the bullet. The bullet remains attached to the gun housing via cables whereby retrieval of the gun pulls the imbedded coring bullet from the sidewall.

In U.S. Pats. Nos. 3,043,379 and 3,080,005, the sampling means comprises a plurality of shaped charges arranged within the gun housing so as to cut formation samples from the sidewall. The shaped charges are oriented in a converging pattern whereby a high velocity stream of hot gases and particles emitted by the burning shaped charges severs a formation sample from the sidewall. The sample is collected in a pocket within the gun housing immediately below the shaped charges.

Still another sampling means, such as is shown in U.S. Pats. Nos. 2,928,658 and 2,976,940, comprises a combination of coring bullets and shaped charges. In this case, coring bullets are used to secure a sample from the sidewall and shaped charges are used to dislodge the sample or the coring bullet from the sidewall.

Conventionally, as in the case of the sidewall core guns described in the above-noted patents, the core gun is suspended within the borehole on a wireline. Accordingly, the coring bullets and shaped charges are fired by electrical firing means. Such firing means comprises, for example, electrical wires which terminate in a resistance-heated wire, such as a nichrome wire. The resistance-heated wire, when energized, ignites a detonator, which, in the case of the coring bullet, detonates an explosive charge. Typically, the explosive charge is a gas generator which launches the coring bullet by means of gaseous expansion acting on a rearward surface thereof. In the case of a shaped charge, the detonator fires the shaped charge or an ignition train leading thereto.

Core guns which employ hollow coring bullets without the aid of shaped charges are particularly susceptible to problems associated with retrieval of the coring bullets from the surrounding formation. The use of coring bullets without shaped charges is desirable because of the additional expense and complexity added to the gun by the shaped charges. However, if the explosive charge used to launch the coring bullet is excessively powerful, the coring bullet may lodge deep within a consolidated formation. When the gun is retrieved, the cables connecting the coring bullets to the gun housing, being under substantial tension, may sever, leaving the bullets buried within the formation. In other cases, where formation resistance to the intruding coring bullet is minimal, the connecting cable may be severed by the force of the explosive charge alone. Thus, proper control of the force generated by the explosive charge is critical to successful retrieval of the coring bullets.

If the cables connecting the coring bullets to the gun housing are strengthened to facilitate bullet retrieval in consolidated formations, the substantial tension acts first on the wireline connecting the gun housing to the surface, subjecting the wireline to risk of severance. Some hydrocarbon formations are so highly consolidated as to preclude the firing and retrieval of more than one coring bullet at a time without risking severance of the wireline. Thus, taking core samples in a highly consolidated formation can be a time-consuming process.

Each of the sidewall core guns described above is also susceptible to a problem common to all wireline operations—the guns are operable only in vertical or substantially vertical boreholes. The more a borehole is deviated, the less likely it is that one will be able to obtain from it formation samples by use of a sidewall core gun. Hence, it appears that the known prior art methods and apparatus relating to sidewall core guns do not provide adequately for the taking of formation samples from within a deviated borehole.

SUMMARY OF THE INVENTION

Accordingly, a sidewall core gun structured in accordance with the principles of the invention is affixed to the downhole end of a string of drill pipe and includes a housing, sampling means disposed within the housing, a charge assembly for propelling the sampling means into the sidewall of a borehole, and means for retrieving the sampling means.

The sampling means is preferably at least one coring bullet having a generally cylindrical shape and a hollow interior. The bullet is oriented generally radially of the housing whereby it may be propelled from the housing toward the sidewall of a borehole.

The charge assembly preferably includes a relatively small diameter detonator cord and at least one cartridge assembly including therein a charge, deflagration of which propels the coring bullet away from the housing. The cord extends in a generally axially passage through the housing and may be connected via booster charges to cord in other core guns. Thus, a string of core guns may be connected serially along a length of cord.

The cartridge assembly is disposed within the housing between the cord and the coring bullet, whereby the cord may ignite the charge within the cartridge assembly and thereby launch the coring bullet. The cartridge assembly includes a case having a substantially solid portion, adjacent to the cord, and a substantially hollow portion, adjacent to the bullet. The hollow portion includes a propellant charge therewithin. Ignition is communicated from the detonating cord through the solid portion of the case to the propellant charge, which deflagrates and generates gas, launching the coring bullet.

The solid portion of the case may include therethrough a small diameter passage extending from the hollow portion to the exterior of the case. A first transfer charge disposed within the passage transfers ignition from the detonating cord to the deflagrating propellant charge. The cartridge assembly is designed so as to insure that the first transfer deflagrates, rather than detonates. A second transfer charge may be included within the hollow portion of the casing to insure uniform ignition of the propellant charge.

Thus, a detonating cord transfers sufficient energy to the solid portion of the case to ignite the first transfer charge in the passage therethrough. The first transfer charge is consumed at a low detonation velocity, transferring ignition to a second transfer charge within the hollow portion of the case. The second transfer charge also burns at a low detonation velocity and ignites uniformly the propellant charge. The propellant charge generates a gas on deflagration, thereby propelling the coring bullet into the sidewall of the borehole.

The core gun of the present invention is attached to the downhole end of a string of drill pipe. The use of drill pipe, as opposed to a conventional wireline, to position the core gun within the borehole enables the taking of core samples from within deviated boreholes. The weight of the drill string is sufficient to overcome such deviations. In addition, a drill string can support a longer string of core guns than can a wireline and can apply a greater force to the core gun for retrieval of the coring bullets from the sidewall.

The use of a detonating cord in the ignition train is essential to obtain reliable ignition of the cartridge assembly. The use of a deflagrating propellant charge affords greater control over the velocity at which the coring bullet departs the housing and thus improves the reliability of coring bullet recovery and maximizes the life of the core gun hardware. The present invention provides a novel means for transferring ignition from the detonating cord to the deflagrating propellant charge.

These and various other characteristics and advantages of the present invention will become readily apparent to those skilled in the art upon reading the following detailed description.

BRIEF DESCRIPTION OF THE DRAWINGS

For a detailed description of the preferred embodiment of the invention, reference will now be made to the accompanying drawings, wherein.

DESCRIPTION OF THE PREFERRED EMBODIMENT

The use of sidewall core guns for taking formation samples from the sidewall of a vertical or substantially vertical borehole is well known. Typically, the core gun is suspended on a wireline and lowered to the desired depth within the borehole. Where the borehole is deviated, however, the core gun will not follow the borehole. Consequently, formation core samples cannot be taken in deviated well bores by conventional wireline core guns.

Figure 1:
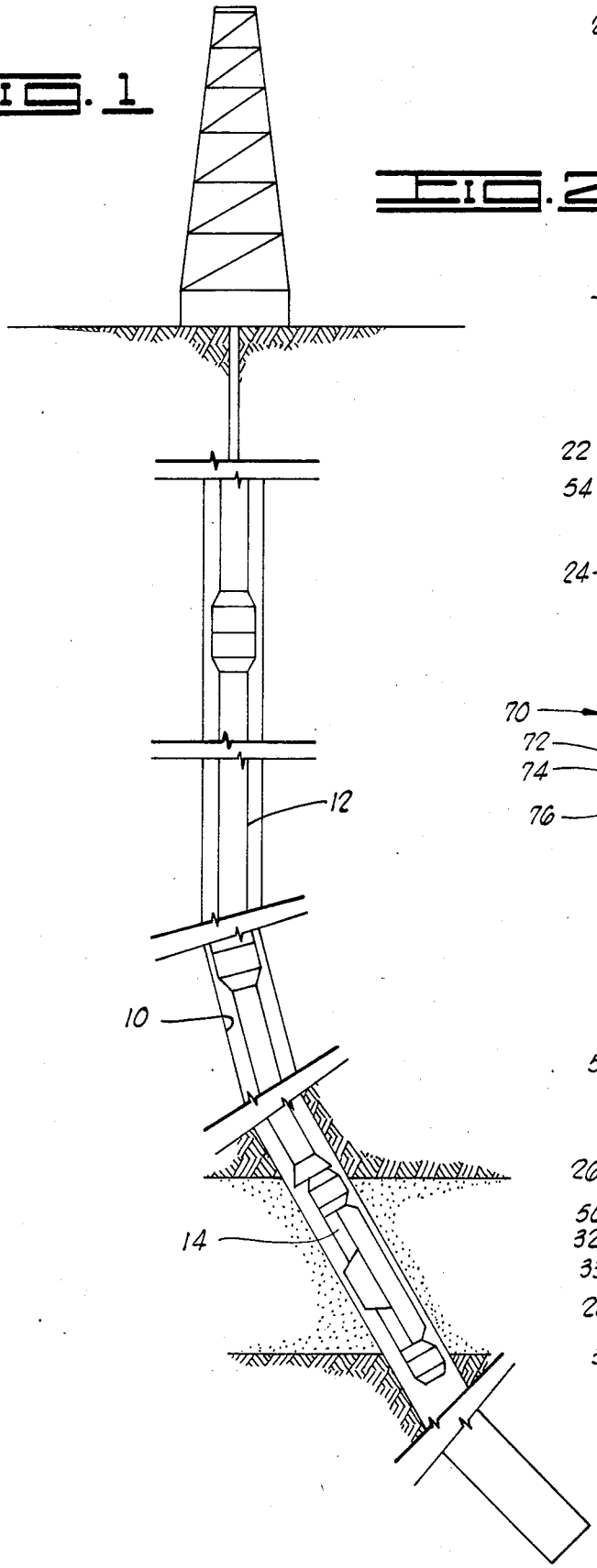
FIG. 1 depicts a string of drill pipe within a deviated well bore, a sidewall core gun constructed in accordance with the principles of the invention being attached to the downhole end of the drill string.

The present invention solves the foregoing problem by securing a core gun to the lower end of a string of drill pipe. Thus, a core gun which would otherwise become lodged in the deviated portion of a well bore may be pushed through the deviation by the weight of the column of drill pipe. There is shown in FIG. 1 in a diagrammatical format a deviated borehole 10 having suspended therein a string of drill pipe 12. The lower end of the drill string 12 supports a sidewall core gun 14 structured in accordance with the principles of the present invention.

The Gun Housing

Figure 2:
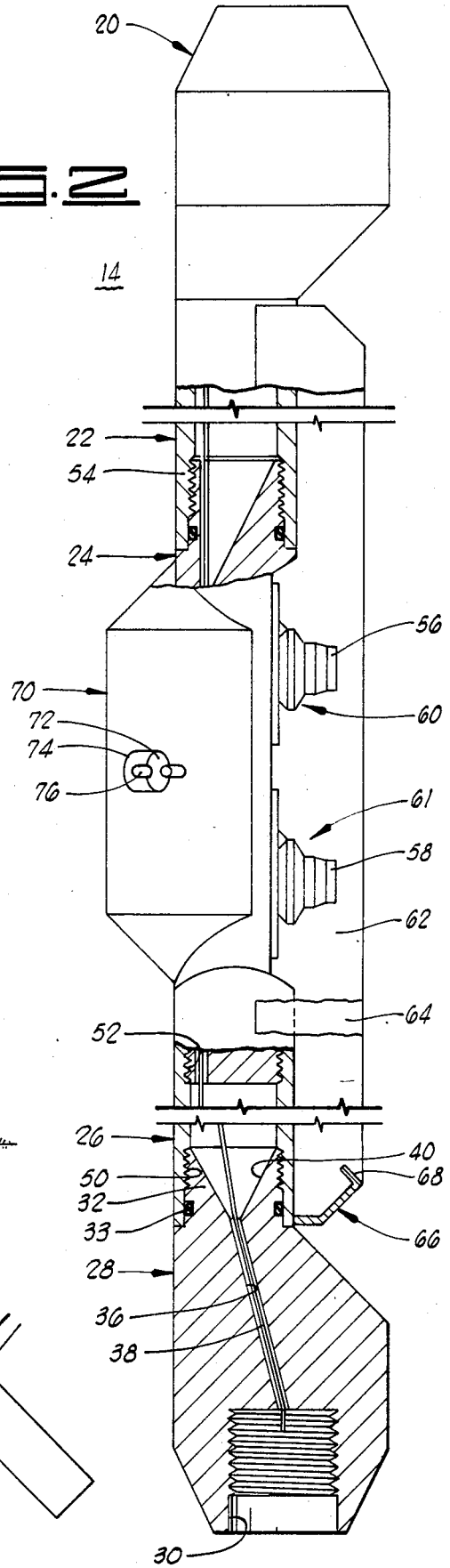
FIG. 2 depicts the sidewall core gun of FIG. 1 in elevation.

More particularly, the core gun 14 is shown in FIG. 2 in cross-sectional and cut-away format so as to disclose in some detail the structure thereof. The core gun 14 comprises an upper connector 20, an upper housing coupling 22, a charge housing 24, a lower housing coupling 26, and a lower connector 28.

The upper and lower connectors 20,28 include threaded axial bores 30 (shown for the lower connector 28 only) for connecting the core gun 14 to the drill string 12 (FIG. 1) and to a spacer sub (not shown), respectively. The bores 30 are threaded with a standard drill pipe thread whereby the upper connector 20 may be attached directly to the lower end of a joint of drill pipe. The lower connector 28 may be secured via the spacer sub (not shown) to additional guns, whereby a string of guns 14, for example, thirty separate guns, may be spaced at intervals on the lower end of the drill string 12 (FIG. 1). The spacer subs connecting the plurality of guns may be of a variety of lengths and include means for coupling the ignition train from gun to gun.

The upper and lower connectors 20,28 have a generally cylindrical configuration, with the axial centerline of the connectors 20,28 offset from the centerline of the housing couplings 22,26 and the charge housing 24. The internal end of the connectors 20,28, that is, the end which connects to the housing couplings 22,26, includes a threaded extension 32 (shown for the lower connector 28 only) for threaded engagement of the housing couplings 22,26 and an O-ring 33, disposed within a circumferential groove, for providing a fluid seal between opposing surfaces of the connectors 20,28 and the housing couplings 22,26.

The connectors 20,28 further include a generally axial passageway 36 (again, shown for the lower connector 28 only) extending through the connectors 20,28 from the internal to the external end thereof. The axial passageway 36 provides a path for extension of a hot line 38 therethrough. The structure and operation of the hot line 38 is described in the section entitled "The Charge Train." The passageway 36 of the lower connector 28 is tapered at the internal end 40 thereof with decreasing diameter in the downhole direction. The tapered internal end 40 of the passageway 36 facilitates threading of the hot line 38 through the gun 14 from the upper to the lower ends thereof, as further described below.

Referring still to FIG. 2, the upper end and lower housing couplings 22,26 connect the upper and lower connectors 20,28 to the charge housing 24. The housing couplings 22,26 comprise hollow cylinders having threaded interior ends 50, 52, 54 (the upper end of the upper housing coupling 22 is not shown) for threaded engagement of the connectors 20,28 and the two ends of the charge housing 24. It should be noted that, in the alternative, the housing couplings could comprise solid cylindrical elements having threaded bores at the ends 50,52,54 and a generally axial passageway (not shown) therethrough for the hot line 38. It should also be noted that the necessity for housing couplings 22,26 could be eliminated by providing that the downhole end of each element 20,22,24,26 of the gun 14 include male threads and the uphole end of each element 22,24,26,28 include female threads, or vice-versa, whereby the charge housing 24 could be coupled directly to the connectors 20,28 or to additional charge housings. In such a case, the housing couplings may be used as spacing elements between charge housing 24 or connectors 20,28 and charge housings.

The generally cylindrical charge housing 24 supports a pair of charge assemblies 60,61 each including a coring bullet 56,58 and the apparatus associated therewith, for securing formation samples from the sidewall of the borehole. The coring bullets 56,58 are oriented generally radially of the charge housing 24. A single core gun 14 may include a plurality of charge housings 24. Structural details of the charge housing 24 and the charge assembly 60 are described below in reference to FIG. 3.

Figure 5:
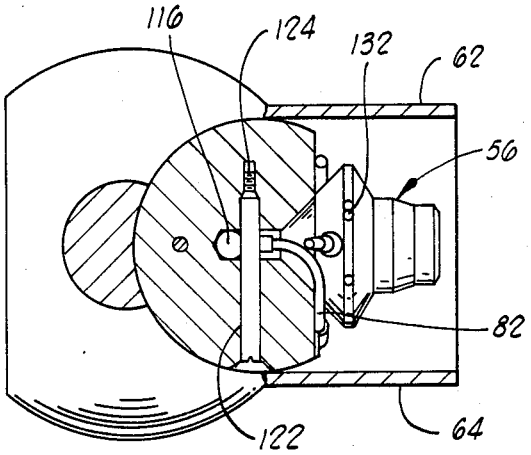
FIG. 5 depicts a cross section of the core gun taken along a line 5—5 shown in FIG. 3.

In addition to the aforedescribed apparatus, the sidewall core gun 14 may further include side shrouds 62,64 (side shroud 64 is depicted in cut-away format) for protecting the coring bullets 56,58 from damage by contact with the sidewall of the borehole during the process of running the core gun 14 into the borehole. The side shrouds 62,64 each comprise a strip of sheet metal extending along a side of the gun 14 between the connectors 20,28 so as to form a channel therebetween for protecting the coring bullets 56,58 which extend outwardly from the chare housing 24. FIG. 5 shows the side shrouds 62,64 in cross section. The side shrouds 62,64 are adjoined at the ends thereof by upper and lower end plates 66 (only the lower end plate 66 is depicted in FIG. 2). Each end plate 66 comprises a perpendicular extension between the side shrouds 62,64, including an interiorly extending portion 68 for preventing the end plates 66 from gouging portions of the sidewall as the core gun 14 is run in and out of the borehole.

Referring still to FIG. 2, the core gun 14 may include, where necessary, a bracing fixture 70. The bracing fixture 70 is an apparatus removably secured to the core gun 14 at, for example, the charge housing 24, for effectively increasing the outer diameter of the core gun 14. Thus, without the bracing fixture 70, the core gun 14 is properly sized for one size borehole; with the bracing fixture 70, the core gun 14 is properly sized for a larger diameter borehole.

Figure 7:
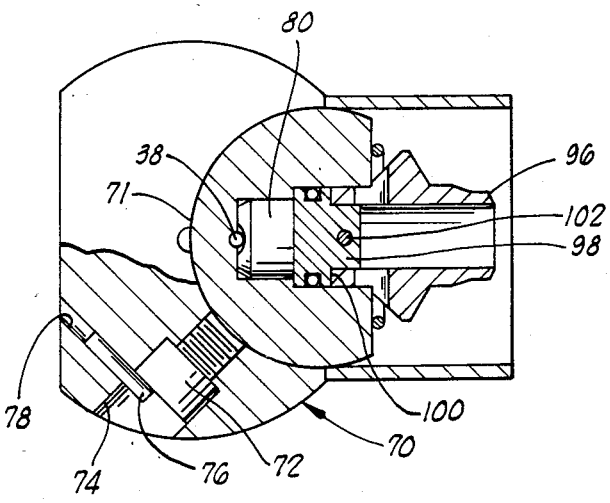
FIG. 7 shows a cross section of the core gun taken along a line 7—7 shown in FIG. 3.

Referring briefly to FIG. 7, the bracing fixture 70 is secured to the rearward side 71 of the charge housing 24 by means of a bolt 72 threadedly engaged within the fixture 70 and tightened against the charge housing 24. The bracing fixture 70 is shaped to conform to the generally cylindrical exterior of the charge housing 24 whereby a single bolt 72 provides a secure attachment of the bracing fixture 70. The upper end of the bolt 72 is recessed within a counterbore 74. A latching pin 76 extends through an intersecting bore 78 and across the upper end of the bolt 72 to prevent the bolt 72 from loosening.

The Charge Assembly

Figure 3:
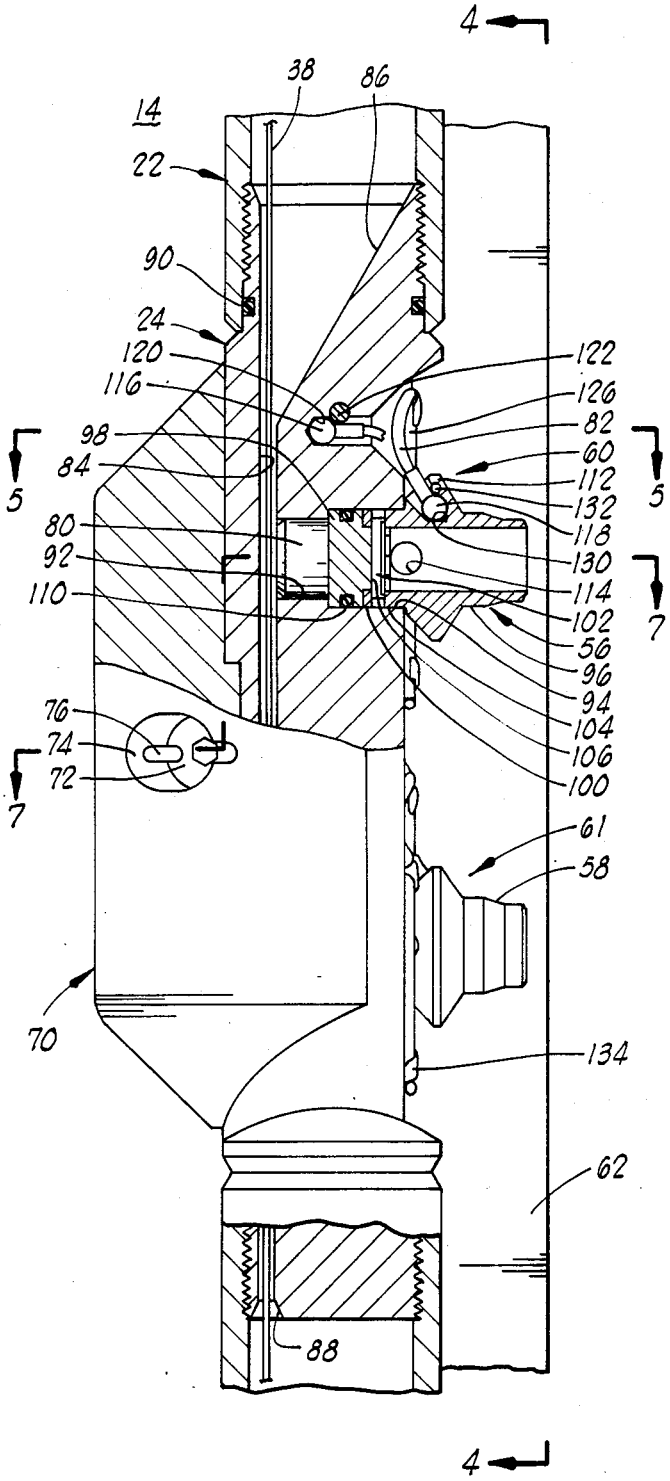
FIG. 3 depicts a portion of the core gun elevation of FIG. 2 larger and in partial cross section.
Figure 4:
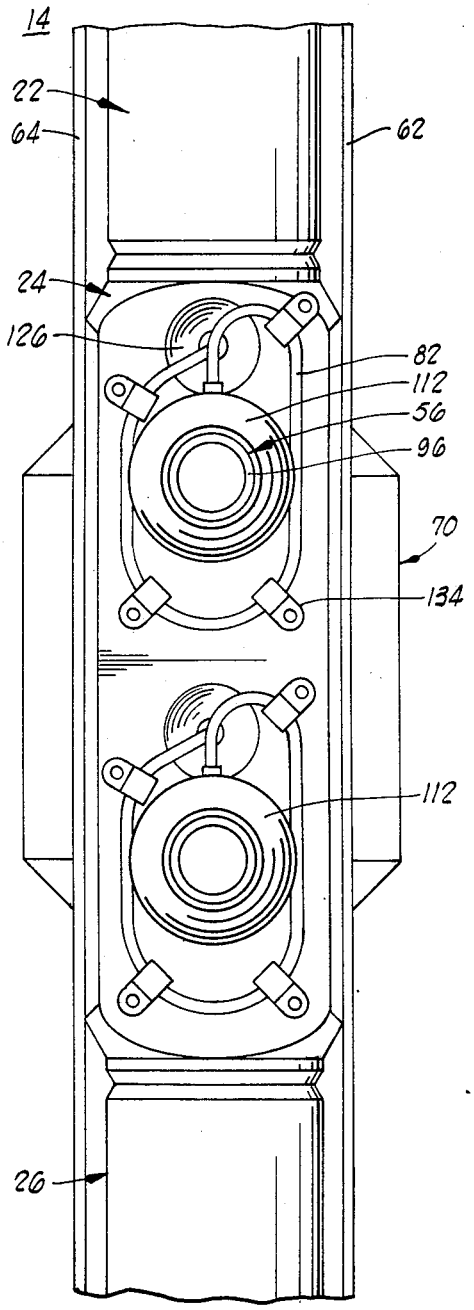
FIG. 4 depicts the core gun of FIG. 3 in a front elevation.

Referring now to FIGS. 3 and 4, where the charge housing 24 is shown in partial cross section and front elevation, respectively, the upper charge assembly 60 includes the hot line 38, a cartridge assembly 80, the coring bullet 56, and a retrieval cable 82. Because the two charge assemblies 60,61 are identical in structure and operation, description of the upper charge assembly 60 shall constitute a full and complete description of both assemblies 60,61.

The hot line 38 is continuous throughout the length of the gun 14 and thus extends along a passageway 84 oriented generally axially through the charge housing 24. The uphole end 86 of the passageway 84 is generally funnel-shaped to facilitate threading the hot line 38 through the gun 14 after assembly thereof. The downhole end 88 of the passageway 84 requires no such funnel shape so long as the hot line is always threaded from the uphole end of the gun 14. It should be noted that each charge housing 24, housing coupling 22,26 (FIG. 2, where such is not hollow by design), and connector 20,28 (FIG. 2) should be similarly structured with a funnel-shaped uphole end narrowing to a passageway extending generally axially thereto) should be similarly structured with a funnel-shaped uphole end narrowing to a passageway extending generally axially therethrough, whereby a continuous passageway is formed. The funnel-shaped uphole end guarantees an obstructed path through a plurality of housing members.

The uphole end of the charge housing 24 further includes an o-ring 90 disposed within a circumferential channel, whereby the charge housing 24 is protected against fluid contamination. Each such junction between housing units 20,22,24,26,28 should be similarly sealed.

The cartridge assembly 80 is disposed in a radially extending, cylindrical charge bore 92 within the charge housing 24. The charge bore 92 intersects at an interior end thereof the passageway 84 whereby the hot line 38 is in intimate contact with a portion of the cartridge assembly 80. Referring briefly to FIG. 7, the alignment of the hot line 38 across the axial centerline of the cartridge assembly 80 may be observed. The structure of the cartridge assembly 80 is described below in the section entitled "The Charge Train" in reference to FIG. 6.

Referring again to FIG. 3, the coring bullet 56 is partially disposed within a radially extending, cylindrical bullet bore 94. The bullet bore 94 intersects generally coaxially with, and is of slightly greater diameter than, the charge bore 92 and extends from the charge bore 92 to the exterior of the charge housing 24.

The coring bullet 56 itself includes a hollow cylindrical portion 96 and a base portion 98. The inwardmost extension of the cylindrical portion 96 abuts against a shoulder 100 formed on the outwardly extending end of the base portion 98. A pin 102 extends through corresponding axial bores 104,106 within the cylindrical and base portions 96,98, respectively, to removably connect the two portions 96,98. The removable base portion 98 provides means for accessing a core sample and removing it intact from the cylindrical portion 96 once the gun 14 has been retrieved. The base portion 96 further includes an o-ring 110 disposed within a circumferential groove to prevent fluid contamination of the cartridge assembly 80 and the hot line 38.

The cylindrical portion 96 of the coring bullet 56 includes a generally centrally located wing ring 112 extending circumferentially about the exterior thereof. The wing ring 112 serves to impede penetration of the coring bullet 56 into the surrounding formation to prevent the bullet 56 from becoming buried too deeply therein. The ring 112 further serves to open the entrance path of the bullet 56 into the formation to a diameter greater than that of the bullet 56 generally so as to facilitate retrieval thereof.

The cylindrical portion 96 of the coring bullet 56 further includes radial ports 114 near the base portion 98. The radial ports 114 provide a vent for fluids trapped within the hollow cylindrical portion 96 when the coring bullet 56 penetrates the sidewall formation.

Referring still to FIG. 3, the retrieval cable 82 comprises a length of steel aircraft cable, for example, sixteen inches, having a tensile strength preferably in the range of 6,000 to 10,000 pounds. Each end of the cable 82 includes a ball fitting 116, 118 swaged thereto. The charge housing 24 includes a generally radial bore 120 into which a first ball fitting 116 is received and maintained therein by means of a locking pin 122. Referring briefly to FIG. 5, the locking pin 122 is threadedly engaged within an intersecting bore 124 so as to prevent the ball fitting 116 from escaping the radial bore 120. A generally funnel-shaped counterbore 126 about the radial bore 120 minimizes the risk that an edge of the radial bore 120 will damage or sever the retrieval cable 82.

The second ball fitting 118 on the retrieval cable 82 is received within a bore 130 in a rearward surface of the ring wing 112 and maintained therein by a locking pin 132 in the same manner that the first locking pin 122 retains the first ball fitting 116 within the bore 160 in the charge housing 124.

The retrieval cable 82 is retained against the charge housing 24 by means of a plurality of straps 134. As the coring bullets 56,58 move toward the sidewall, the retrieval cable 82 is stripped from the straps 134, which are forcibly deformed, one by one, to release the cable 82.

The Charge Train

The sidewall core gun may be fired by any of several methods. It is anticipated, for example, that fluids will be circulated through the drill string to a perforated nipple positioned immediately above the core gun and then out of the drill string and up the annular area between the drill string and the borehole to the surface. A ball switch device, such as is described and shown in FIG. 5 of co-pending U.S. patent application Ser. No. 493,081, filed May 9, 1983 entitled "Ball Switch Device and Method," assigned to the assignee of the present invention, could be used, whereby a ball is pumped down the drill string until it contacts a specially adapted seat at the upper end of the core gun, initiating a firing sequence.

Alternatively, where conditions permit, a metal bar could be dropped through the drill string to initiate the firing sequence, as shown and described in U.S. Pat. No. 3,706,344, or the drill string could be pressurized to actuate a pressure sensitive firing head on the core gun, as shown and described in copending U.S. patent application Ser. No. 481,069, filed Mar. 31, 1983, entitled "Gun Firing Head," assigned to the assignee of the present invention. It is anticipated that a variety of other methods for initiating the firing sequence could be developed as well.

The present invention provides an improved firing sequence by combining the reliable ignition associated with a detonating cord and a controllable projectile velocity associated with a deflagrating propellant. The firing sequence is initiated by causing the uphole end of the hot line 38 to begin to detonate. The hot line 38 is a relatively small-diameter, for example, 0.125 to 0.150 inch, detonatable cord manufactured by Ensign Bickford of Simsbury, Conn. It is comprised of a relatively high temperature explosive, hexanitrolstilbene ($C_{14}H_6N_6O_{12}$), and a pyrotechnic diluent, boron potassium nitrate ($BKNO_3$), encased in an aluminum sheath. The combination of $C_{14}H_6N_6O_{12}$ and $BKNO_3$ will detonate at the lower end of detonation velocities, for example, 2,000 to 5,000 feet per second. Conventional prima cord, which detonates at roughly 5000 to 7000 feet per second, is not suitable for the charge train described herein because it generates too much energy for the proper ignition of the cartridge assembly 80. By contact, a deflagrating charge burns at a rate less than that of a detonating charge, for example, in the range of 1000 to 2000 feet per second.

The hot line 38 is preferably continuous throughout each core gun and is interconnected between guns or spacers by means of booster charges (not shown). As previously described, the cartridge assembly 80 for each coring bullet is positioned adjacent to a portion of the hot line 38.

Figure 6:
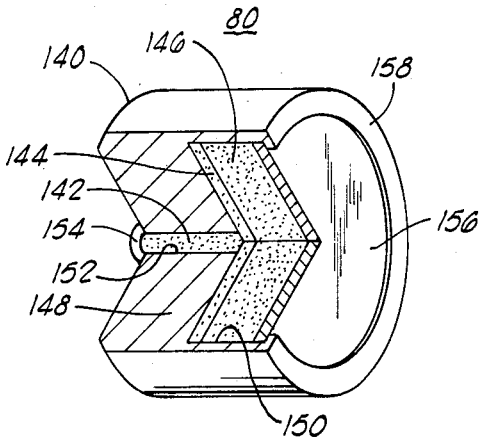
FIG. 6 shows a power cartridge for launching a coring bullet from the core gun.

Referring now to FIG. 6, the cartridge assembly 80 comprises an aluminum case 140, a first transfer charge 142, a second transfer charge 144, an output charge 146 and a large closure disk 156. The generally cylindrical case 140 includes a substantially solid portion 148 and a hollow portion 150 for encasing the second transfer and output charges 144, 146. The solid portion 148 includes a bore 152 through the axial centerline thereof, approximately 0.065 to 0.070 inch in diameter, for housing the first transfer charge 142.

The transfer and output charges 142,144,146 are sealed within the case 140 by means of a small closure disk 154 enclosing the bore 152 in the solid portion 148 of the aluminum case 140 and the large closure disk 156 enclosing the hollow portion 150 of the case 140. The small closure disk 154 may be, for example, an adhesive-backed Kapton disk, which is a thin-film polyimide disk manufactured by 3M Company. The large closure disk 156, which also may be a Kapton disk, is received within the hollow portion 150 of the casing 140 and retained therein by crimping the upper cylindrical walls 158 of the casing 140 over the disk 156.

The first transfer charge 142 comprises a mixture including twenty milligrams of titanium potassium perchlorate ($TiKClO_4$) consolidated at 1,000 pounds per square inch (psi). Detonation energy of the hot line is absorbed by the aluminum case 140 in an amount just sufficient to ignite the $TiKClO_4$. The minimal diameter and chemical composition of the columnar mixture of $TiKClO_4$ limits the burn velocity of the mixture to approximately 3,000 to 4,500 feet per second, at the lower end of the scale of detonation velocities. This feature is critical to the proper transfer from a detonating hot line to a deflagrating output charge, as described further below.

The second transfer charge 144 is a mixture including 200 milligrams of $TiKClO_4$ consolidated with the output charge 146 at 1,000 psi. The second transfer charge 144 is ignited by the energy generated by the first transfer charge 142 and transfers ignition substantially uniformly to the the output charge 146. Once again, the configuration and chemical composition of the second transfer charge 144 limits its burn rate to low detonation velocities.

The output charge 146 is preferably a propellant comprised of 50% Hipel 710 and 50% Hipel 3500 consolidated at 1,000 psi Hipel 710 is a trade name for a hydroxyl-terminated polybutidiene (HTPB) propellant, comprising 84% ammonium perchlorate ($NH_4ClO_4$) (oxidizer), 9.1% HTPB (fuel), 0.7% aluminum trihydrate ($Al_2O_3x3H_2O$) (burn rate catalyst), 0.2% $Fe_2O_3$ (burn rate stabilizer), and 6% polymide (Kermid 601). Hipel 3500 is also a propellant, comprised of 57.7% $NH_4ClO_4$, 38.5% tetramethylammonium perchlorate (TMAP), and 3.8% Viton A. It has been determined by experimentation that a 538.5% tetramethylammonium perchlorate (TMAP), and 3.8% Viton A. It has been determined by experimentation that a 50/50 blend of the foregoing propellants will deflagrate and propel the coring bullets at an optimum velocity. The output charge 146, as described herein, deflagrates at approximately 650 to 700 feet per second rather than detonates.

A denotating charge generates instantaneous pressures in the range of approximately 300,000 to 3,500,000 pounds per square inch (psi), regardless of the size of the charge. Such intense pressures render control of the launch velocity of the coring bullet immensely difficult and have a devasting impact on the core gun hardward enclosing and supporting the output charge. Thus, the use of a detonating output charge greatly limits the life of key portions of the core gun itself. A deflagrating charge, by contrast, generates instantaneous pressures less than approximately 75,000 psi. These comparatively lower pressures afford greater control over the launch velocity of the coring bullet and fall within a range which the core gun hardware can withstand. Hence, the present invention provides an improved charge train including a detonating cord, which provides reliable ignition of charges connected thereto, a deflagrating output charge, which provides improved control over coring bullet velocity and a longer life cycle of core gun hardware, and transfer charges to transfer ignition from the detonating cord to the deflagrating output charge.

The Formation Marker

Figure 8:
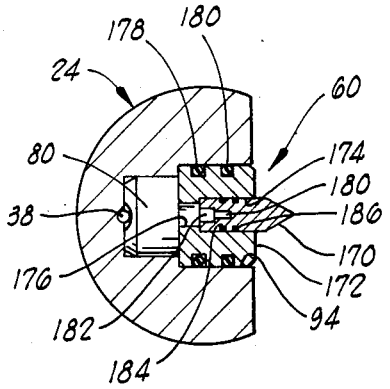
FIG. 8 shows a formation marker in cross section.

Referring now to FIG. 8, in place of a coring bullet, the charge assembly 60 may include instead of formation marker 170. The formation marker 170 is a projectile which includes therein a trace amount of a radioactive substance, so that the location from which a particular core sample is taken may be marked for future reference by imbedding the radioactive market within the formation.

A marker support housing 172 is disposed within the aforedescribed bullet bore 94 in the charge housing 24. The support housing 172 is necessary to adapt the charge housing configuration to the smaller formation marker 170. The generally cylindrical marker support housing 172 includes an axial marker bore 174, for receiving the formation marker 170, and a coaxial expansion bore 176 of slighter lesser diameter than the marker bore 174. The expansion bore 176 provides a path for communicating to the formation marker 170 gases generated by deflagration of the cartridge assembly 80, which is identical to the cartridge assembly used with the coring bullets. The marker support housing 172 also includes a pair of o-rings 178,180 disposed in circumferential channels about the exterior thereof.

The formation marker 170 comprises a tapered nose projectile having a small axial bore 180 for receiving a radioactive substance and a threaded axial counterbore 182 for enclosing the small bore 180. The formation marker 170 also includes a pair of o-rings 184,186 disposed within circumferential channels about the exterior thereof.

Operation of the Sidewall Core Gun

Referring now to FIG. 1, the sidewall core gun 14 is attached to a joint of drill pipe and lowered via the drill string 12 into the deviated borehole 10. Upon reaching the desired depth within the borehole 10, the gun firing sequence is initiated by any one of the aforedescribed methods. Assume, for example, that a ball is pumped down the drill string 12 until it contacts a specially adapted seat at the uphole end of the gun 14. In response to such contact, a percussion primer is fired in accordance with methods well known in the art and the hot line is ignited.

Referring now to FIG. 2, the hot line 38 is continuous throughout the lenth of the gun 14 and is coupled through spacer subs (not shown) to additional guns, whereby the hot line 38 effectively is continuous throughout an entire string of guns (not shown). Referring now to FIGS. 3 and 7, the hot line 38 passes adjacent to each cartridge assembly 80 so that detonation energy generated by the hot line 38 is transferred virtually simultaneously to each cartridge assembly 80 in the gun 14. As the detonating hot line 38 passes each cartridge assembly 80, the small closure disk 154, shown in FIG. 6, is fused and the solid portion 148 of the aluminum case 140 absorbs sufficient energy to ignite the first transfer charge 142.

Referring still to FIG. 6, the first transfer charge 142 burns rapidly, but fails to reach a detonation velocity in excess of approximately 4,500 feet per second before the charge 142 is consumed. Energy generated by the first transfer charge 142 is communicated to the second transfer charge 144 by intimate contact between the two charges 142,144 as well as by heat transfer through the solid portion 148 of the aluminum case 140. The second transfer charge 144 burns at approximately the same rate as the first transfer charge 142. The arrangement of the second transfer charge 144 in a layer having the same radial dimension as the output charge 146 assures that the output charge 146 ignites uniformly across the surface thereof in intimate contact with the second transfer charge 144.

The output charge 146 is a gas generator which preferably deflagrates rather than detonates, as described above, thereby preserving some measure of control over the magnitude of the force imparted to the coring bullet. Deflagration of the output charge 146 generates gas within the enclosed area formed by the hollow portion 150 of the aluminum case 140 and the large closure disk 156. As the gas pressure within the enclosed area exceeds the strength of the crimped wall 158 of the case 140, the large closure disk 156 is forced from the case 140.

Referring again to FIG. 3, further gaseous expansion due to deflagration of the output charge 146 exerts a force on the base portion 98 of the coring bullet 56 and the coring bullet 56 is propelled from its seat within the bullet bore 94 in the charge housing 24. As the coring bullet 56 proceeds away from the charge housing 24 and toward the sidewall (not shown) of the borehole, the retrieval cable 82, which remains attached to both the coring bullet 56 and the charge housing 24, is stripped from each of the straps 134, one by one as depicted in FIG. 4, which secure the cable 82 to the charge housing.

Referring still to FIG. 3, on reaching the sidewall, the coring bullet 56 begins penetration thereof. The ring wing 112 about the central portion of the coring bullet 56 induces resistance to penetration and gradually slows the coring bullet 56. Depending on the type of formation encountered, the coring bullet 56 may come to a stop before the retrieval cable 82 is stretched to its limit. More likely, however, the retrieval cable 82 will be fully stretched as the coring bullet 56 penetrates the sidewall, providing the limiting force necessary to stop penetration of the coring bullet 56.

Referring now to FIGS. 1 and 3, the core samples are retrieved by raising the drill string 10. As the drill string 10 is raised, the coring bullets 56, 58 are pulled from the sidewall and hang from the charge housing 24 within the protected area defined by the side shrouds 62,64. Once the core gun has been retrieved, the core samples are easily accessed by removing the pin 102 which latches the base portion 98 of the bullet 56 to the cylindrical portion 96 and separating the base and cylindrical portions 98,96. The core samples may then be pushed carefully from the cylindrical portion 96.

Summary

The sidewall core gun 14 of the present invention is attached to the lower end of a drill string and is primarily useful for taking core samples in a deviated borehole where a wirelinesupported core gun is not functional. The core gun 14 may also be useful, however, in any situation where a wireline or electrical apparatus is not suitable, for example, in high temperature applications or in applications requiring a large number of core samples.

The sidewall core gun 14 includes a plurality of coring bullets which are launched by pyrotechnic output charges into the sidewall of the borehole. The output charges are connected serially along a small diameter cord, or hot line, which extends the length of the gun 14. When the hot line is ignited, it detonates along its length, igniting each of the pyrotechnic output charges.

The pyrotechnic output charges comprise deflagrating propellant charges which generate gas and thereby propel the coring bullets away from the gun 14. The pyrotechnic output charges are ignited by transfer charges, which are ignited by the detonating hot line.

The coring bullets are retrieved from the sidewall by means of steel cables connecting the bullets to the gun 14. As the drill string is raised, the bullets are pulled from the sidewall and returned to the surface with the gun 14. While a preferred embodiment of the invention has been shown and described, modifications thereof can be made by one skilled in the art without departing from the spirit of the invention.

What is claimed is:

1. A cartridge assembly for a sidewall core gun for transferring the energy form a detonating cord upon the detonation thereof to propel a coring bullet from said gun, said cartridge assembly comprising:

a housing defining therein a first chamber at one end of said housing and a second chamber at the other end of said housing;

an output charge disposed within a portion of the second chamber at the other end of said housing, said output charge having a first end surface and a second end surface;

a first transfer charge having a first end surface and a second end surface being disposed within the first chamber in said housing, said first transfer charge having the first end surface thereof located adjacent said detonating cord and being capable of transmitting energy from said detonating cord upon the detonation thereof; and a second transfer charge disposed within a portion of the second chamber and having a portion thereof in contact throughout the first end surface of said output charge and having a portion thereof in contact with the second end surface of said first transfer charge, said second transfer charge capable of transferring energy from said first transfer charge to said output charge to cause the activation thereof.

2. Apparatus according to claim 1, wherein:

said housing is generally cylindrical;

the first chamber in one end of said housing extends through one end thereof while the second chamber extends through the other end thereof; and said output charge and said first transfer charge are enclosed within the second chamber and the first chamber of said housing respectively by means of closure disks covering the ends of said housing.

* * * * *

UNITED STATES PATENT AND TRADEMARK OFFICE

CERTIFICATE OF CORRECTION

PATENT NO. : 4,702,168

DATED : October 27, 1987

INVENTOR(S) : Edward A. Colle, Jr. et al.

It is certified that error appears in the above-identified patent and that said Letters Patent is hereby corrected as shown below:

In column 9, line 35, delete the word [hardward] and insert therefor —hardware—.

Signed and Sealed this

Twelfth Day of April, 1988

Attest:

DONALD J. QUIGG

Attesting Officer

Commissioner of Patents and Trademarks